US006105513A

United States Patent [19]

Mittag

[11] Patent Number: 6,105,513

[45] Date of Patent: Aug. 22, 2000

[54] SHELVING BASE METHOD AND SYSTEM

[75] Inventor: Douglas C. Mittag, Bolingbrook, Ill.

[73] Assignee: Richards-Wilcox, Inc., Aurora, Ill.

[21] Appl. No.: 09/309,874

[22] Filed: May 11, 1999

[51] Int. Cl.[7] ..... A47B 9/00

[52] U.S. Cl. ..... 108/107; 108/106

[58] Field of Search ..... 108/107, 106, 108/180, 192, 193, 153.1, 144.11, 147.11, 147.12; 211/166; 312/357, 265.2

[56] References Cited

U.S. PATENT DOCUMENTS

| | | | |
|---|---|---|---|
| 2,802,575 | 8/1957 | Harrison | 108/106 |
| 3,050,194 | 8/1962 | Sinninger | 108/106 |
| 3,411,634 | 11/1968 | Pesce | 211/186 X |
| 4,034,683 | 7/1977 | DiCenzo | 108/107 |
| 4,949,648 | 8/1990 | Miller | 108/107 |

FOREIGN PATENT DOCUMENTS

| | | | |
|---|---|---|---|
| 1024102 | 1/1978 | Canada | 211/186 |
| 2415441 | 9/1979 | France | 211/186 |

*Primary Examiner*—Jose V. Chen
*Attorney, Agent, or Firm*—Hill & Simpson

[57] ABSTRACT

A shelving unit apparatus and method comprises vertical posts arranged at corners of a rectangle. A plurality of shelves are vertically spaced from one another and supported by the posts. At a front of the shelving unit, a channel-shaped base rests on a floor on which the shelving unit rests, the base being attached to the front two posts at ends of the base by projecting head rivets received in keyhole-shaped slots in the front two posts. At least one aperture in the base portion of the base receives a mounting bolt to be anchored to the floor. The bottom shelf has its front end resting on an upper edge of the front vertical wall of the base. A rear of the bottom shelf is supported by a shelf holding element attached to the two posts at the rear of the shelving unit.

24 Claims, 4 Drawing Sheets

SHELVING BASE METHOD AND SYSTEM

BACKGROUND OF THE INVENTION

As shown in FIG. 1 illustrating a prior art shelving base system, a shelving unit 10 is bolted by a plurality of bolts 5 to a floor 19. The side of the shelving unit has a panel 8 running from top to bottom which has a right angle bent-over flange 9 at the base thereof cut short of the corners. In an aperture 6, the bolt 5 attaches the flange 9 to the floor 19.

As is known in the prior art, four vertical posts 12 are provided at the four corners of the shelf. These posts 12, as more clearly shown in FIG. 8, have a closed channel 12A facing the front and the back of the shelving unit and a flange 12B at the sides where the side panels 8 of FIG. 1 attach. In the closed channel portion 12A slots 13 which are keyhole shaped in known prior art fashion are provided for receiving shelf supports 16 which in turn support shelves 14 having a front lip 14A. Shelf supports 16 are formed in known prior art fashion as shown in FIGS. 2A and 2B in the side view and end view respectively, and in FIG. 1 also in an end view. The shelf supports have a base portion 16C, a short lip vertical wall 16A, and a longer vertical wall 16B. As illustrated in FIG. 2A, there are mounting ears 16D and 16E at each end with each of the mounting ears having projecting rivets 16F, 16G, 16H, and 16I with each of the projecting rivets having a projecting head portion 4 such as shown in the end view of FIG. 2B and a tail portion 3 where they mount in respective apertures in the ears 16D and 16E of the supports.

Referring again to FIG. 1, a front kick plate or base plate 15 having a bottom bent-over edge 15A at right angles is provided at the front and at the back of the shelving unit. This base plate 15 at its upper end 15B slips in a space between the vertical wall 16B of the shelf support 16 and the overhang lip 14A of the shelf 14.

With this prior art unit, if a user of the shelving unit accidentally kicks the base plate 15 it can be easily bent in. It is difficult to repair this bent plate since the shelf 14 must be removed and it must be re-formed. Typically, such base plates are formed of thin steel sheeting, such as 24 gauge.

If desired, an additional reinforcement channel 18 may be provided having a U-shape with sidewalls 18A and a base portion 18B on which the shelf 14 rests. A notch 18C is provided in each sidewall 18A to receive the short vertical wall 16A of the shelf support 16. The front end 18D of the reinforcement channel 18 abuts against an inner surface of the vertical wall 16B of the shelf support 16.

SUMMARY OF THE INVENTION

It is an object of the present invention to solve the problem of bent base plates in the prior art shelving units.

It is a further object of the invention to lower cost, reduce damage in shipment, simplify assembly, and improve the overall strength of the shelving unit by an improved mounting base system.

It is a further object of the invention to strengthen the overall shelving unit relative to tipping thereof.

According to the present invention, a shelving unit is provided having four vertical posts arranged at corners of a rectangle with two of the posts being at a front of the shelving unit. At the front of the shelving unit, a base rests on a floor on which the shelving unit rests, said base being attached to the front two posts at ends of the base by connecting elements mounted to a front vertical wall of the base and received in apertures in the front two posts. At least one aperture in a base portion of the base receives a mounting bolt to be anchored to the floor. A bottom shelf has its front end resting on an upper edge of said front vertical wall of the base. A rear of the bottom shelf is supported by a shelf holding element attached to the two posts at the rear of the shelving unit.

In a method of the invention for supporting a shelving unit on a floor, corner vertical posts are provided at corners of a rectangle. A base is provided having projecting mounting elements. The base is mounted to two of the corner posts at the front of the shelving unit by placing the mounting elements in apertures in the corner posts so that after the base is in position, a floor portion of the base having at least one mounting hole rests on the floor supporting the shelving unit. A shelf holding element is placed in connected position at two rear posts of the shelving unit. A bolt is placed through the mounting hole in the floor portion into the floor to mount the base of the shelving unit to the floor. A bottom shelf is then placed so that a front of the shelf rests on an upper edge of a front vertical wall of the base and with a rear of the shelf resting on the shelf holding element at the rear posts.

With the present invention, there are the following advantages.

First, the improved base of the invention is attached directly to the vertical uprights to keep it more firmly in place.

Secondly, the improved base is made of a 16 gauge or heavier steel to resist damage better.

Thirdly, the bent-over flange has been removed from the side of the shelving unit, reducing damage in shipment.

The location of anchor bolt holes closer to the front and back of the shelving unit increases the moment arm and provides greater resistance to overturning of the shelving unit. Also, the holes are able to be mounted directly to the improved base of the invention which is made of heavier gauge steel and thus provides improved supporting. Furthermore, since with the improved base the mounting holes are away from the side panels it is easier to access those mounting holes during mounting of the shelving unit to the floor.

The improved base is of a stronger material, is shaped in a U-shape, and provides more resistance to overturning of the shelving unit.

Assembly is easier than the prior art kick plate system because two parts (kick plate and shelf support) are being replaced by one part—the improved base.

Most importantly, because of the improved structure of the base, it is far less likely to be bent when people or objects accidently hit the front of the base.

DESCRIPTION OF THE PREFERRED EMBODIMENTS

Figure 3:
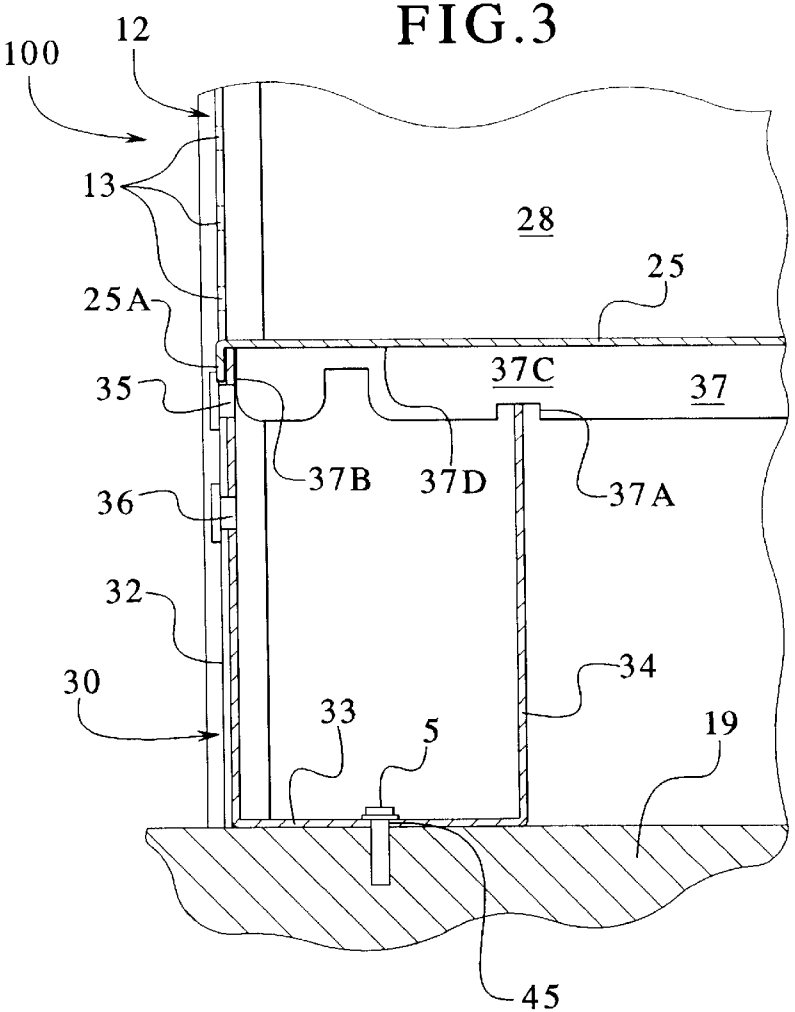
FIG. 3 is a side cross-sectional fragmentary view taken along line III—III of FIG. 4 of the improved base system for a shelving unit according to the invention.
Figure 1:
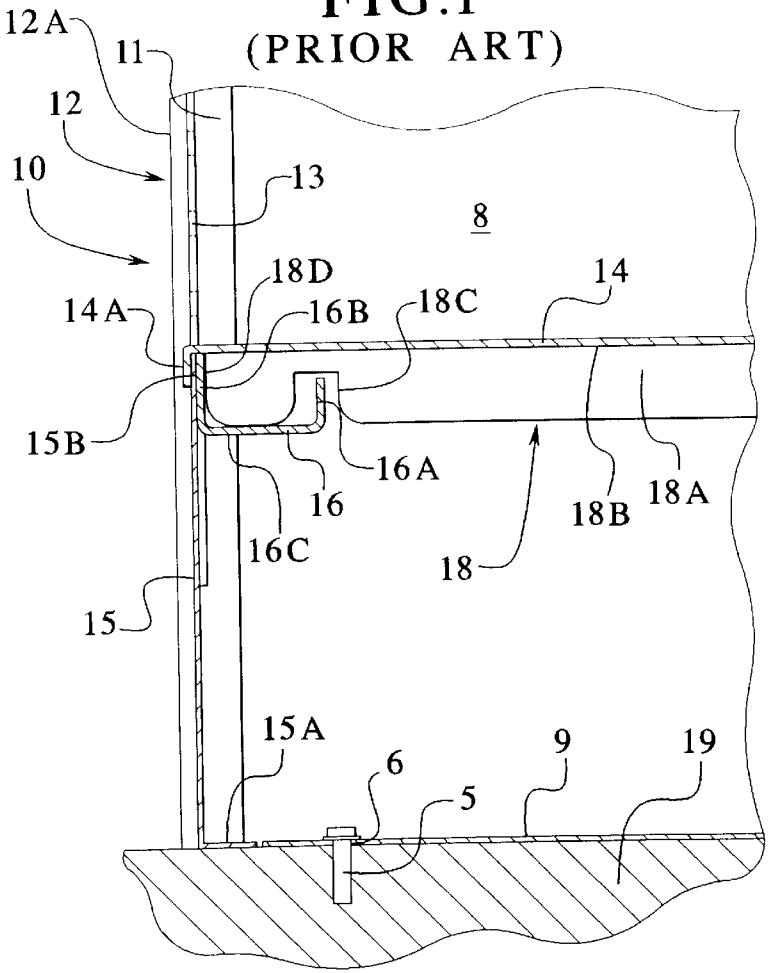
FIG.1 (PRIOR ART)
FIG. 1 is a side partial view showing the prior art shelving unit with a prior art kick plate.
Figure 4:
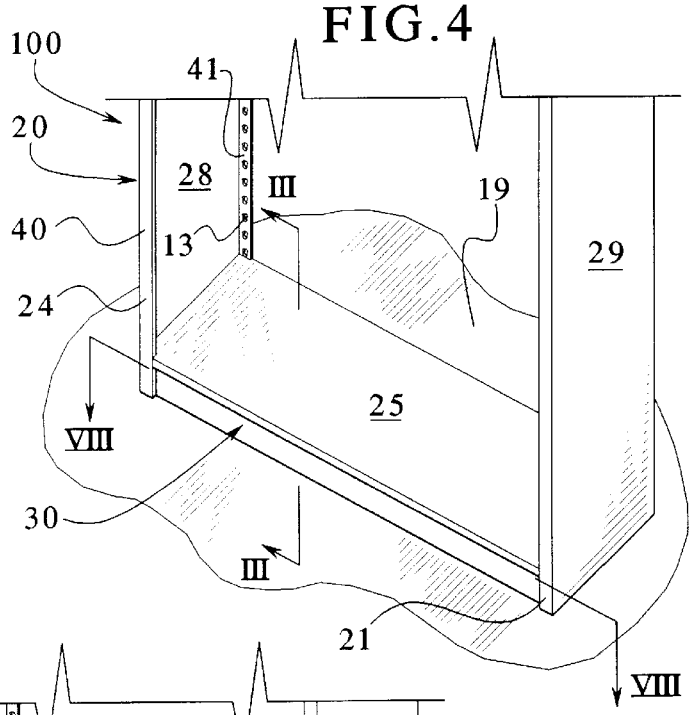
FIG. 4 is a fragmentary perspective view of a bottom of the shelving unit according to the present invention showing the improved base system.
Figure 5:
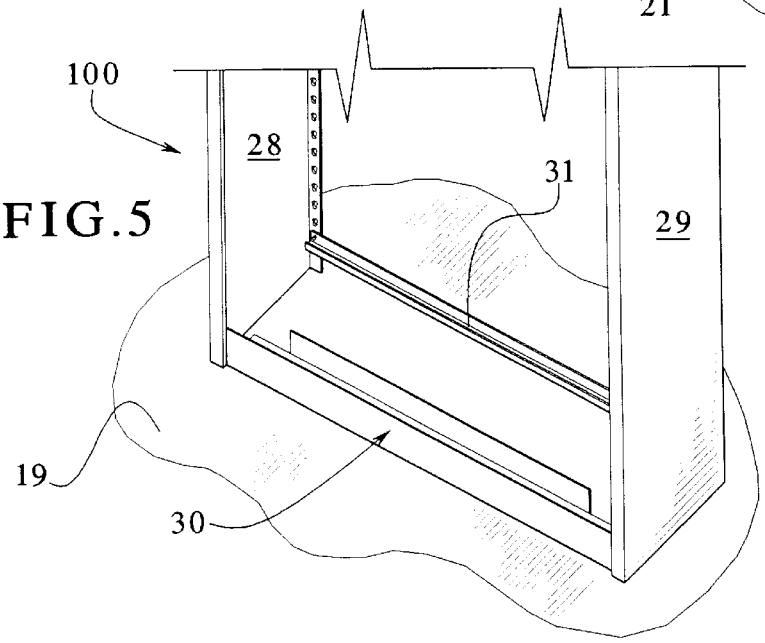
FIG. 5 is the same fragmentary perspective view of FIG. 4 but with the bottom shelf removed.

Referring to FIGS. 3, 4 and 5, the improved base method and system of the present invention for a shelving unit 100 is illustrated. A base 30 preferably formed of at least 16 gauge or heavier steel having a U-shape with a short rear vertical wall 34 and a long vertical wall 32 is joined at the bottom by a base 33. The base or floor portion 33 of the base 30 rests on the floor 19. It has mounting apertures 44 and 45 (see FIG. 6) for receiving the respective mounting bolts 5.

Figure 7:
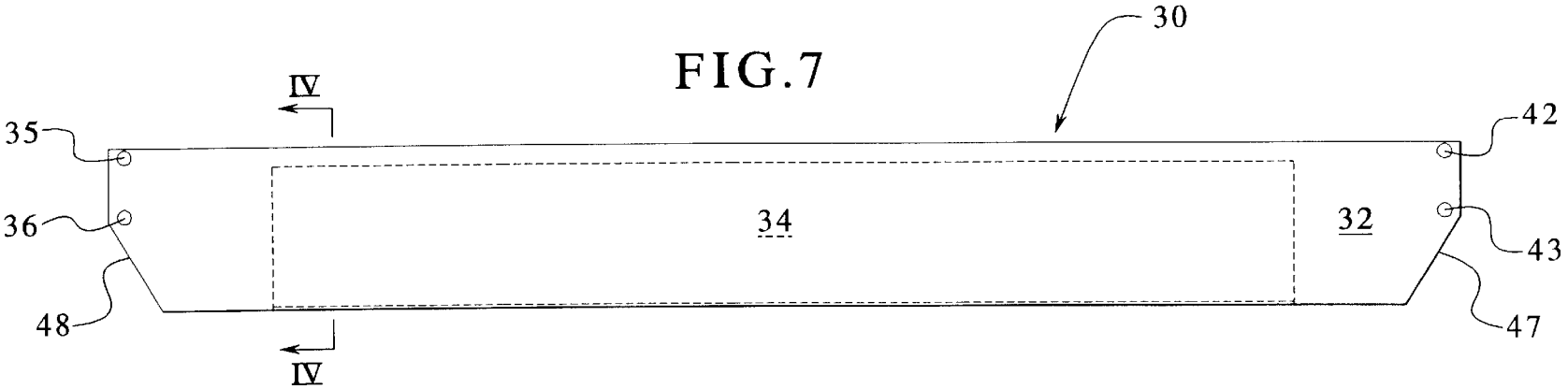
FIG. 7 is a front view of the improved base of the invention.

The base 30 engages with respective vertical posts 12 with four projecting rivets 42, 43, 35, and 36 each having a projecting head portion as shown in FIG. 7 most clearly. These projecting rivets are received in respective keyhole-shaped slots 13 of the posts 12.

Figure 8:
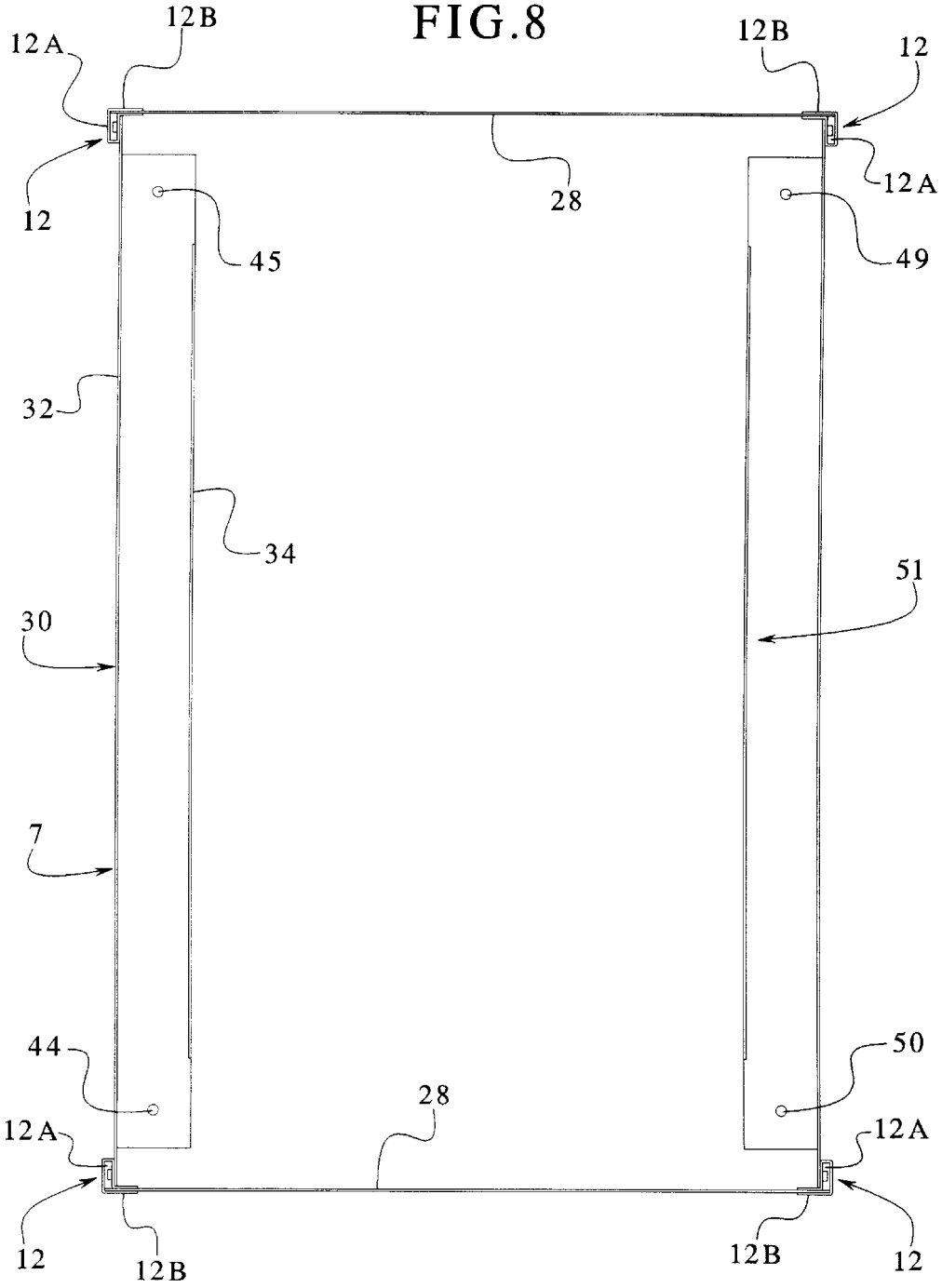
FIG. 8 is a top view taken along line VIII—VIII of FIG. 4 showing a plan view of the improved base system of the present invention.

As shown in FIG. 3, the side wall 28 at the bottom of the overall shelving system does not have a flange as in the prior art. The side panel 28 is mounted between doubled walls of the vertical posts 12 as shown in FIG. 8.

The improved shelving unit 7 of the invention has its bottom shelf 25 with a lip 25A overhanging the front tall vertical wall 32 of the base 30. If desired, an additional reinforcement channel 37 may be provided having a cutout 37A for receiving the top end of the short rear vertical wall 34 of the base 30. The reinforcement channel 37 has a front edge 37B butting up against the inner side of the taller front vertical wall 32 of the base 30. The reinforcement channel 37 has side walls 37C and an upper roof portion 37D on which the shelf 25 rests.

Figure 2A:
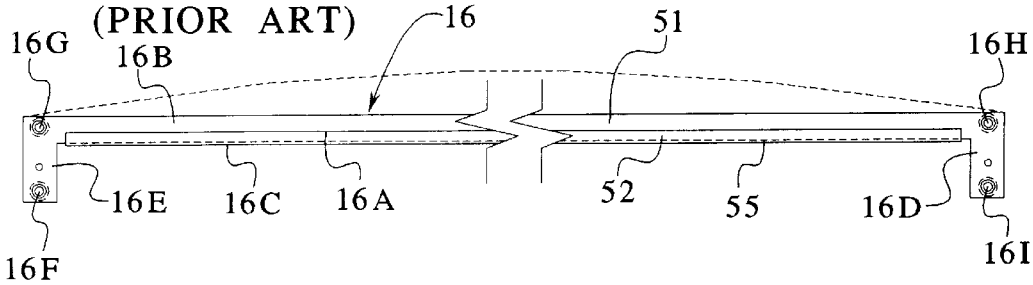
FIG.2A (PRIOR ART)
FIG. 2A and FIG. 2B are respectively a rear view and an end view of the prior art shelf support shown in FIG. 1.
Figure 2B:
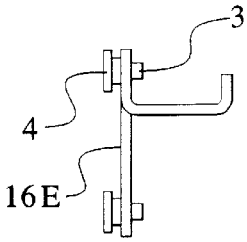
FIG.2B (PRIOR ART)

The back end of the shelving unit 7 may have a similar base such as 30, or alternatively may employ the shelf support of the prior art design such as shown in FIGS. 2A and 2B.

Figure 6:
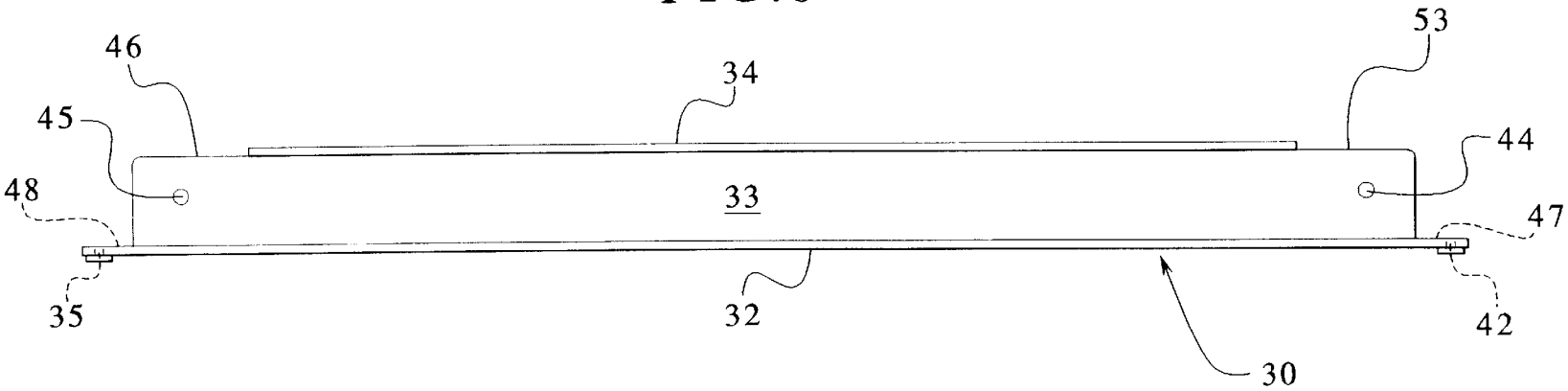
FIG. 6 is a top view of the improved base of the present invention.

As shown in FIGS. 6 and 7, the short rear wall 34 has a shorter length then the floor portion 33 since horizontal cuts 46 and 53 are provided. This provides clearance for mounting the base since where the holes 44 and 45 are located in the floor portion 33 of the base that area is spaced from the side walls 28 of the shelving unit. Also, a slanting transition cuts 47 and 48 are provided from the floor portion 33 to the tall front wall 32.

FIG. 8 shows the mounting holes 44 and 45 and additional mounting holes 49 and 50 if an additional improved base 51 is employed at the backside of the shelving unit 7 in lieu of the shelf support. As can be seen in this view, the mounting holes 44 and 45 are close to the front wall 32 of the base 30 so as to provide overall strength to the unit.

As can be seen according to the present invention, the improved base 30 is a combination of the prior art kick plate 15 and channel 16, and therefore replaces two parts by one.

Although various minor modifications might be suggested by those skilled in the art, it should be understood that I wish to embody within the scope of the patent warranted hereon all such modifications as reasonably and properly come with the scope of my contribution to the art.

I claim as my invention:

1. A shelving unit, comprising:

four vertical posts arranged at corners of a rectangle with two of the posts being at a front of the shelving unit;

a plurality of shelves vertically spaced from one another and supported by the four posts;

at the front of the shelving unit, a channel-shaped base having a front vertical wall, a base portion, and a rear vertical wall, and resting on a floor on which the shelving unit rests, said base being attached to the front two posts at ends of the base by projecting head rivets having head portions mounted to the front vertical wall of the base and received in keyhole-shaped slots in the front two posts;

at least one aperture in the base portion of the base for receiving a mounting bolt to be anchored to the floor;

a bottom shelf having its front end resting on an upper edge of said front vertical wall of the base; and a rear of the bottom shelf being supported by a shelf holding element attached to the two posts at the rear of the shelving unit.

2. The shelving unit according to claim 1 wherein the bottom shelf has a front lip overhanging the upper edge of the base front vertical wall.

3. The shelving unit according to claim 1 wherein the base rear vertical wall is shorter than a height of the front vertical wall.

4. The shelving unit according to claim 1 wherein the base portion of the base has two apertures for mounting bolts spaced apart near ends of the base.

5. The shelving unit according to claim 1 wherein the front vertical wall of the base has at each end two vertically arranged projecting rivets each having a head portion.

6. The shelving unit according to claim 1 wherein below the head rivets the ends of the front vertical wall of the base slant inwardly to the base portion and wherein at the rear vertical wall of the base ends of the rear vertical wall are spaced inwardly of ends of the base portion of the base.

7. The shelving unit according to claim 1 wherein the shelf holding element at the rear of the bottom shelf comprises another base identical to the base at the front of the shelving unit.

8. The shelving unit according to claim 1 wherein the shelf holding element at the rear of the bottom shelf comprises a shelf support attached to the two rear posts of the shelving unit.

9. The shelving unit according to claim 8 wherein the shelf support is U-shaped and has at ends thereof at least one projecting head rivet with a respective head portion receivable in respective tear-shaped slots in the rear posts.

10. The shelving unit according to claim 1 wherein at least one inverted U-shaped reinforcement channel runs from the front of the bottom shelf to the rear of the bottom shelf and rests at the front on an upper edge of the rear vertical wall of the base.

11. The shelving unit according to claim 10 wherein the reinforcement channel has a cutout for receiving said top edge of the rear vertical wall of the base.

12. The shelving unit according to claim 11 wherein the reinforcement channel in addition to said cut-out also has an additional cut-out as a clearance for a vertical wall of a U-shaped shelf support at the rear of the shelf so as to allow the rear of the reinforcement channel to be supported by a base portion of the U-shaped shelf support provided at a rear end of the bottom shelf.

13. The shelving unit according to claim 10 wherein a front end of the reinforcement channel abuts against an upper portion of said front vertical wall of the base.

14. The shelving unit according to claim 1 wherein the base is constructed of at least 16 gauge or heavier steel.

15. The shelving unit according to claim 1 wherein outer front ends of the front vertical wall of the base abut against an inner wall having said keyhole-shaped slots of the front two posts.

16. The shelving unit according to claim 1 wherein the four posts each have a front portion forming a rectangular channel having keyhole-shaped slots on an inner surface thereof and also a side flange.

17. The shelving unit according to claim 1 wherein the shelving unit has side panels without a flange at the bottom so that on a bottom edge of the side panels rest directly on the floor.

18. The shelving unit according to claim 1 wherein the side panels are received in sandwich fashion between two metal layers of a side flange of the vertical corner posts.

19. A shelving unit, comprising:

four vertical posts arranged at corners of a rectangle with two of the posts being at a front of the shelving unit;

at the front of the shelving unit, a channel-shaped base having a front vertical wall, a base portion, and a rear vertical wall, and resting on a floor on which the shelving unit rests, said base being attached to the front two posts at ends of the base by connecting elements mounted to a front vertical wall of the base and received in apertures in the front two posts;

at least one aperture in a base portion of the base for receiving a mounting bolt to be anchored to the floor;

a bottom shelf having its front end resting on an upper edge of said front vertical wall of the base; and a rear of the bottom shelf being supported by a shelf holding element attached to the two posts at the rear of the shelving unit.

20. A method for supporting a shelving unit on a floor, comprising the steps of:

providing corner vertical posts at corners of a rectangle;

providing a base having projecting mounting elements and mounting said base to two of said corner posts by placing the mounting elements in apertures in the corner posts so that after the base is in position a floor portion of the base having at least one mounting hole rests on the floor supporting the shelving unit;

providing the base as a U-shape having said front vertical wall, said floor portion, and a rear vertical wall, shorter than the front vertical wall;

placing a shelf holding element in connected position at two rear posts of the shelving unit;

placing a bolt through the mounting hole in the floor portion into the floor to mount the base of the shelving unit to the floor; and placing a bottom shelf so that a front of the shelf rests on an upper edge of a front vertical wall of the base and with a rear of the shelf resting on the shelf holding element at the rear posts.

21. The method according to claim 20 including the step of providing the rear shelf support as an identical base as the base at the front of the shelving unit and mounting the identical base to the rear posts in a same fashion as the front base is mounted to the front posts.

22. The method according to claim 20 wherein the rear shelf holding element comprises a U-shaped shelf support spaced from the floor when it is mounted to the rear posts.

23. The method according to claim 20 including the step of providing the projecting mounting elements as head rivets having heads and placing heads of the head rivets into keyhole-shaped slots in the corner posts when mounting the base to the front two corner posts.

24. The method according to claim 20 including the step of placing a reinforcement channel so that a front of the reinforcement channel rests on the shorter rear vertical wall of the base prior to placement of the bottom shelf onto the upper edge of the front vertical wall.

* * * * *